United States Patent [19]

Movassaghi

[11] Patent Number: 4,968,244

[45] Date of Patent: Nov. 6, 1990

[54] PULSE COMBUSTOR

[76] Inventor: Mehrzad Movassaghi, 115, 2121 W. 6th Ave, Vancouver, BC, Canada, V6K 1V5

[21] Appl. No.: 362,818

[22] Filed: Jun. 7, 1989

[51] Int. Cl.[5] ..... F23C 3/02

[52] U.S. Cl. ..... 431/1; 431/354; 431/160; 60/39.77

[58] Field of Search ..... 431/1, 354, 160; 60/39.76, 39.77, 247; 122/24

[56] References Cited

U.S. PATENT DOCUMENTS

| | | | |
|---|---|---|---|
| 2,523,308 | 9/1950 | Kemmer et al. | 60/39.77 X |
| 3,359,737 | 12/1967 | Lewis | 60/39.77 X |
| 4,640,674 | 2/1987 | Kitchen | 431/1 |
| 4,708,634 | 11/1987 | Vergne | 431/1 |
| 4,846,149 | 7/1989 | Chato | 431/1 X |

*Primary Examiner*—Randall L. Green

[57] ABSTRACT

A pulse combustor having a casing defining a combustion chamber and an exhaust region encircling the combustion chamber. A carburetor is coupled to the casing with an injector for injecting a fuel mixture into the combustion chamber in response to a pressure reduction following combustion in the combustion chamber. An ignitor for initially igniting the fuel mixture in the combustion chamber is provided. Following ignition and a rapid increase in pressure and temperature in the combustion chamber a pressure wave expands radially travelling along the exhaust region and then reversing direction in response to subsequent pressure reduction in the combustion chamber. After a fresh fuel mixture has been injected during the low pressure period it is precompressed by the pressure wave together with at least some of the hot residue from the previous combustion and then again ignites, repeating the cycle. The casing is cooled to enhance the pressure drop during the pressure reduction stage.

18 Claims, 2 Drawing Sheets

PULSE COMBUSTOR

BACKGROUND

The present invention relates to a pulse combustor for the generation of heat energy by self-generating repetitive cycles of combustion of a combustible fuel.

A combustor is a device for burning gaseous, liquid or solid fuel to produce heat which, in turn, is used for heating other materials or to consume combustible waste products. Operation produces a significant change in gas pressure and/or velocity which is used to do work.

There are two distinct categories of combustors, namely conventional and pulse combustors. In conventional combustors air and fuel are introduced into a combustion chamber, compressed and ignited in a continuous process. A major problem with conventional combustors is in achieving stability of the flame used to ignite the fuel because of the required air/fuel ratios. A high air/fuel ratio is needed to optimize turbine efficiency and for controlling efficiency. The principal type of conventional combustor used for turbines consists of an open ended can into which compressed air is directed. Some of this air is channeled into an outer annulus while the remainder is forced through the center. Fuel is introduced by various means such as atomization by a spray nozzle into the center stream of air and ignited by a burner flame. The additional air flowing through the outer annulus is introduced downstream of the flame through various scoops, openings, baffles and diverters in order to maximize the air/fuel ratio and yet keep the flame stabilized by operating at a lower air/fuel ratio in the burner region. In addition to the difficulty in maintaining flame stability, such combustors exhibit several design problems which make the device complex and costly. Gaseous and liquid fuels may be burned but solid fuels such as pulverized coal may not.

A simpler and less costly alternative to a conventional combustor is a pulse combustor. In simple pulse combustors a mixture of air and fuel is initially ignited by a spark from a spark plug. The gases explode, producing a steep pressure rise and temperature increase followed by exhaustion of the gases and a subsequent pressure drop. Cooling by heat exchange at the chamber walls enhances the pressure drop. Reduction of the pressure results in some atmospheric air, fuel and a small portion of the exhaust gases still in the exhaust region to be sucked back into the combustion chamber. The high temperature still present in the chamber causes the new mixture to ignite, repeating the process with pressure waves performing the function of pistons. Known pulse combustors are linear structures in which the exhaust gases and pressure waves resulting from ignition travel down a tube and on the suction phase atmospheric air and some exhaust gases return. Some linear combustors employ valves to obtain positive shut off and thereby obtain higher pressures. Linear pulse combustors are smaller and lighter than conventional combustors for an equivalent power output. However, linear pulse combustors can not be scaled to produce a wide range of outputs. Smaller units tend to perform poorly relative to larger units. In general, linear pulse combustors have high combustion efficiencies, a high thermal efficiency and have low pollutant production, particularly in $NO_x$ species. However, they are relatively noisy and vibrate excessively. Once optimized for best overall performance, it is difficult to operate a linear pulse combustor at a partial load. Linear pulse combustors are unable to operate on fuels having a low latent heat of combustion if designed to operate on fuels having a high latent heat of combustion.

Accordingly, it is an object of the present invention to provide an improved pulse combustor. It is a further object of the present invention to provide a pulse combustor of simple design. It is yet a further object of the invention to provide a pulse combustor capable of operation over a wide variety of sizes and a wide range of loads and values of heat production of the fuel.

SUMMARY OF THE INVENTION

According to the invention there is provided a pulse combustor which includes a casing that defines a combustion chamber and a radial exhaust region in fluid communication with the combustion chamber. Further included is a means for igniting a fuel mixture in the combustion chamber and a carburetor coupled to the casing having means for injecting a pre-determined distribution of fuel mixture into the combustion chamber in response to a pressure reduction following combustion in the combustion chamber. Means for cooling the casing is provided. The exhaust region is provided with dimensions such that pressure waves from combustion occurring in the combustion chamber travel along the exhaust region to the periphery thereof and then reverse direction and pre-compress a fresh gaseous mixture in the combustion chamber together with at least some hot residue. By designing the exhaust region in this way less heat is lost through exhausting hot gases to the atmosphere than if all exhaust gases were discharged. Accordingly, maximum heat transfer can be obtained.

Preferably, the carburetor includes a plurality of hollow needles of a pre-determined pattern providing fluid communication between a liquid or gaseous fuel source, an inlet to the combustion chamber and an air source coupled to the inlet. Utilizing a plurality of hollow needles provides isolation of a fuel chamber from the combustion chamber following combustion and allows pre-selection of the distribution of fuel injection and control over the amount of air aspirated from the air source.

Advantageously, the air is aspirated into the inlet through a gap leading to the atmosphere one wall of which is formed by a wall isolating the fuel chamber from the combustion chamber inlet.

Preferably, the casing is disc shaped so as to define a rotary combustor. Such a shape serves to overcome the high noise level associated with other shapes since the exhaust gases flow in a radially outward direction through the entire gap at the perimeter of the discs resulting in a lower velocity of the exhaust gases in the disc combustor than in other types of combustors. This leads to a reduction in noise in the disc combustor since such noise normally has a seventh power dependence on exhaust velocity.

DESCRIPTION OF THE DRAWINGS

The novel features believed characteristic of the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
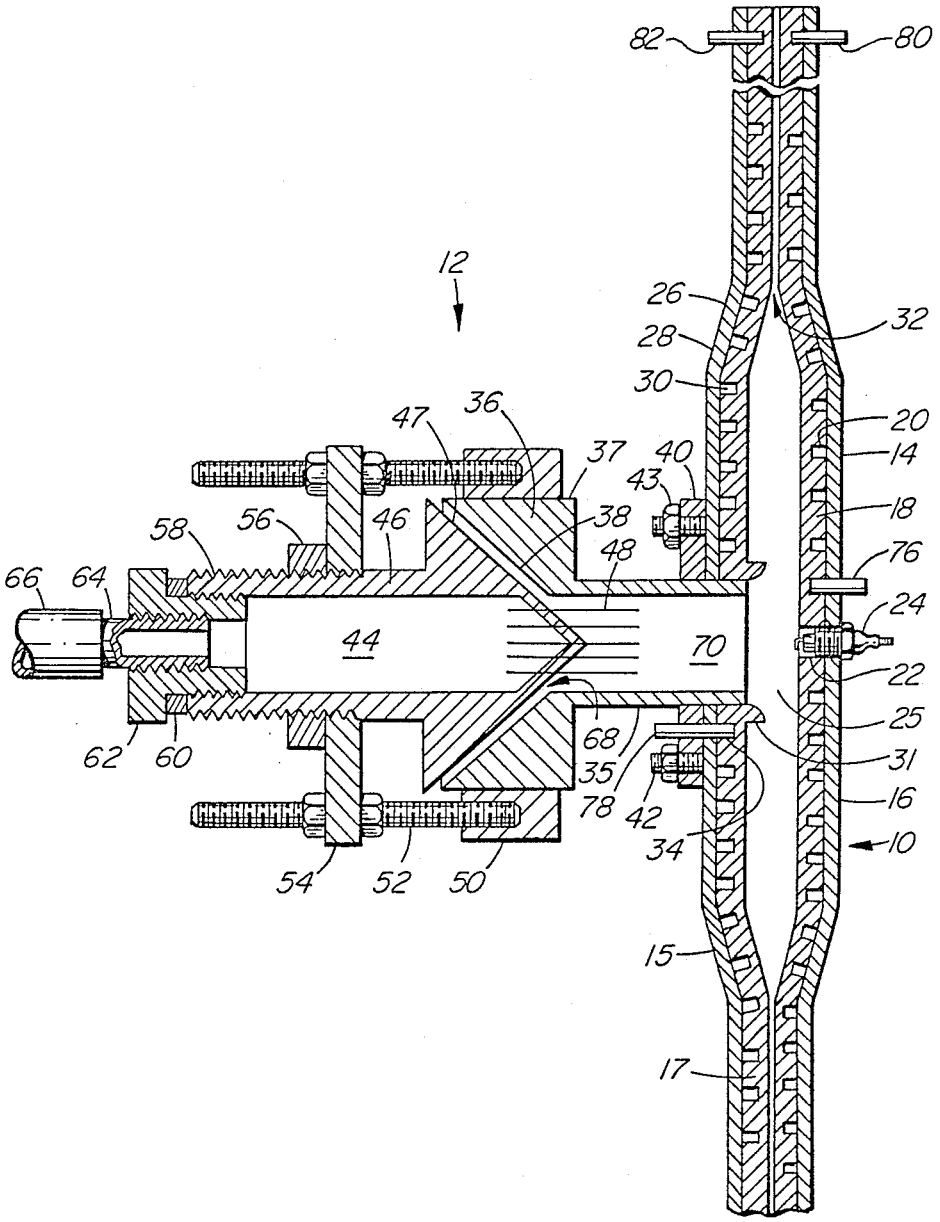
FIG. 1 is a sectional elevation view of the central portion of the combustor casing and attached carburetor.

Referring to FIG. 1 a combustor casing 10 is formed by a back disc 14 juxtaposed and affixed to a front disc 15 so as to form an enlarged central combustion chamber 25 and a narrow surrounding radially disposed exhaust region 32. The ratio of the volume of the exhaust region 32 to the combustion chamber is 9.6 but can range from 9 to 12 assuming the portion with converging walls belongs to the combustion chamber 25. The back disc 14 is made up of an internal back disc plate 18 in which is formed a spiral coolant passageway 20 extending over the whole of the surface of plate 18. An external back disc plate 16 is affixed to plate 18 and covers the coolant passageway 20. Coolant inlets 80 and 82 and outlets 76 and 78 are provided for each disc 14 and 15, respectively. At the center of the back disc is a threaded spark plug opening 22 for threaded engagement with a standard spark plug 24.

Similarly, front disc 15 is made up of an internal front disc plate 17 with a coolant passageway 30 and an external front disc plate 26 affixed to plate 17. A central circular opening 34 is formed in front disc 15 with lip 31 formed around the interior thereof. Three equi-spaced threaded studs 42 are welded to plate 28 around opening 34.

A carburetor 12 made up of a throat 36 and a nozzle 46 is attached to combustor casing 10 by means of a plate 40 which is affixed to throat 36. Holes in plate 40 pass over studs 42 and nuts 43 threaded onto studs 42 are used to tighten plate 40 and hence throat 36 in place in opening 34.

Throat 36 is made up of a tubular portion 35 which fits into opening 34 and an enlarged cylindrical portion 37. A conical surface 38 is formed in the end of portion 37 opening to the interior of the tubular portion 35.

A split ring collar 50 fits over and tightens onto enlarged cylindrical section 37 of throat 36. Elongated studs 52 threaded into collar 50 are used to position a nozzle mounting plate 54.

Figure 5:
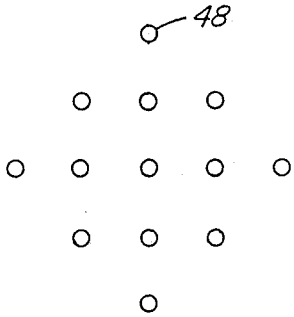
FIG. 5 is an end view of the needles showing the needle pattern.

Plate 54 threadedly engages threads 58 on an outer cylindrical surface at one end of a nozzle 46 to position a conical surface 47 at the other end of nozzle 46 adjacent conical surface 38 of throat 36. A locking flange 56 threadedly engages threads 58 and locks plate 54 in place. The interior of nozzle 46 has a cylindrical chamber 44. At the conical end a plurality of parallel disposed hollow needles extend through conical surface 47. FIG. 5 shows the number and pattern of the needles used. This number and pattern may change with a change in carburetor tuning in order to achieve optimum operation. At the opposite end of nozzle 46 there is threadedly inserted a hollow bushing 62 sealed to nozzle 46 by an O-ring 60. A tubular insert 64 is threaded into an opening in an end of bushing 62 and a flexible hollow tube 66 forced over insert 64.

A key parameter in the carburetor is the gap 68 between nozzle conical surface 47 and throat conical surface 38. This gap 68 is designed to allow the entry of air into fuel inlet 70. This air flow is induced by aspiration caused, in turn, by the effect of the jets of gas from needles 48 and obviously depends on the number, distribution, size and length of the needles 48, the gap width, the length of the inlet 70, the pressure difference between pressure in nozzle chamber 44 and that in inlet 70, the diameter of inlet 70 and other factors. A desired gap width can be set by adjusting the position of nozzle mounting plate 54 along collar studs 52. Surfaces 47 and 68 are made as smooth as possible to minimize air-friction.

Figure 2:
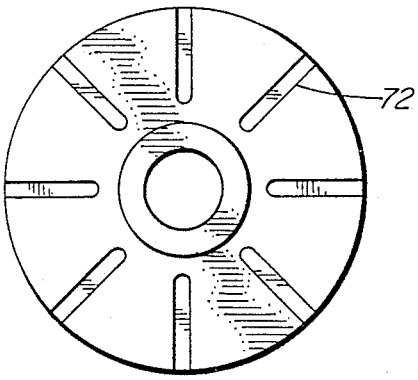
FIG. 2 is a plan view of an interior surface of the back disc.
Figure 3:
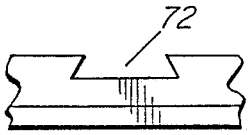
FIG. 3 is a partial end view of one of the dovetail slots in the back plate.
Figure 4:
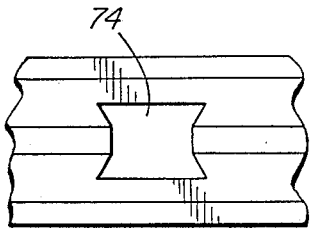
FIG. 4 is a partial perspective view of a portion at the periphery of the combustor casing.

As seen in FIGS. 2 to 4, on an interior surface of each internal disc plate 17 and 18 there are formed six radial equi-spaced dovetailed key ways 72 extending from a periphery across an exhaust portion of the plates 17 and 18. As seen in FIG. 4, dovetail keys 74 are slidably inserted into dovetail keyways so as to affix the back disc 14 and front disc 15 together and accurately set the spacing between the discs.

The operation of the pulse combustor proceeds in a cyclic fashion. Assuming the pressure in chamber 25 is less than that in nozzle chamber 44, fuel enters the nozzle chamber 44 through tube 66 and bushing 62, into needles 48 and emerges into inlet 70 as a plurality of high velocity jets. These jets cause air to be aspirated between conical surfaces 47 and 38 into inlet 70 where it mixes with the jets of fuel. The resulting mixture enters combustion chamber 25.

Initially a spark from spark plug 24 ignites the fuel mixture causing a rapid increase in heat and pressure generating pressure waves which travel radially outwardly into the exhaust region 32 expelling most of the combustion products from the combustion chamber 25. Inertia forces initially tend to maintain an outflow into both the exhaust region 32 and into the inlet 70. Rapid cooling occurs due to the expansion and by means of heat exhange at the walls dropping the pressure in the combustion chamber 25 to a sub-atmospheric level. This low pressure in the combustion chamber 25 results in the flow in the inlet to reverse its direction and the higher pressure of the atmosphere and in the nozzle chamber 44 to push a fresh charge of fuel and air into the combustion chamber 25. At the same time the flow in the exhaust region 32 decelerates, comes to rest and reverses direction. Some atmospheric air is also admitted through the outer periphery of the exhaust region 32 as the reversed inflow pre-compresses the mixture of fresh fuel, air and hot residue from the previous combustion. This results in another rapid combustion heat release and the cycle repeats itself without a need for ignition from the spark plug 24. The operating frequency is typically in the range of 300–800 Hertz.

The gap between the front and back discs 15 and 14 respectively and the diameter of the combustion chamber 25 as compared to the exhaust region are critical in achieving the exact required volume for both the combustion chamber 25 and the exhaust region 32. A combustion chamber width of ¼" and diameter of 4½" reducing with sidewalls converging at 25° to a plane through the center of the combustion chamber 25 and exhaust region 32 to an exhaust region of ⅛" in width and extending from 6¾" out to 24" in diameter has also provided good performance. The diameter of the exhaust region 32 is important so as to ensure rarefaction waves which come to rest at the perimeter of the exhaust region 32 and then return towards the combustion chamber 25 do not reach the combustion chamber 25 either too soon or too late. If too soon, the increase in the pressure of the combustion chamber will prevent the induction of the required volume of air necessary for explosion. If the rarefaction waves enter the combustion chamber 25 too late, the new volume of air and gas will not be adequately pre-compressed, and complete combustion of the new volume of air and gas will not take place. Consequently, after a number of cycles the combustor will not pulsate and will function as a conventional burner with steady combustion requiring spark from the spark plug 24 for continued explosion. An exhaust region to combustion chamber volume ratio of 9.60 has been found to yield good performance.

In the carburetor 12, one of the major factors affecting combustion is the mixture of gas and air. Hence, the pattern and diameter of the needles 48 are important in order to induce entry of sufficient air. In the present embodiment thirteen injector needles 48 of 16 gauge are used in the pattern shown in FIG. 5.

The gap 68 between the throat conical surface 38 and the nozzle conical surface 47 affects the volume of gas injected and the volume of air induced into the combustion chamber 25. If the gap is too large, all of the gas injected from the needles 48 does not enter the combustion chamber 25 If the gap is too small, sufficient volume of air can not be induced into the combustion chamber 25.

Another factor affecting the volume of air induced is the surface finish of the conical surface 47 and the angle subtended at the peak of the cone.

The depth of the fuel inlet 70 is another important parameter of system performance. If the inlet 70 is too long, combustion will take place there rather than in the combustion chamber 25. If the inlet 70 is too short, most of the combustion products will exit the combustion chamber 25 through the inlet 70 and between conical surfaces 47 and 38 after each explosion. An inlet length as measured from the outlet of needles 48 of approximately 1 inch has been found suitable. As a result sufficient volume of air can not be induced, due to a large volume of high pressure exhaust gases leaving the inlet 70 and, therefore, proper combustion can not be achieved.

It has been found that a pressure slightly in excess of atmospheric pressure is required in nozzle chamber 44 in order to achieve proper injection.

Advantages of a radial pulse combustor over linear combustion include increased efficiency and reduced size. Advantages of radial pulse combustors over axial pulse combustors include an increased range of heat release capacity, reduced noise level, less pollution, simplicity and a wide range of fuel burning capability.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A pulse combustor, comprising:

(a) a casing defining a combustion chamber and an exhaust region encircling said combustion chamber and in fluid communication therewith;

(b) igniting means for igniting a fuel mixture in said combustion chamber;

(c) a carburetor coupled to said casing having means for injecting a pre-determined distribution of fuel mixture into said combustion chamber in response to a pressure reduction following combustion in said combustion chamber; and (d) means for cooling said casing;

wherein said exhaust region having dimensions such that pressure waves from combustion occurring in the combustion chamber travel along the exhaust region before reversing direction and pre-compressing in the combustion chamber a fresh gaseous mixture together with at least some hot residue.

2. A pulse combustor according to claim 1, wherein said carburetor includes a plurality of hollow needles of a pre-determined pattern providing fluid communication between a liquid or gaseous fuel source, an inlet to said combustion chamber and an air source coupled to said inlet.

3. A pulse combustor according to claim 1, wherein said casing is formed by a front and back disc joined so as to form said combustion chamber centrally thereof, and an exhaust region encircling said combustion chamber and in fluid communication with said combustion chamber.

4. A pulse combustor according to claim 1, wherein said cooling means are heat exhanging fluid passageways thermally coupled to said front and back discs.

5. A pulse combustor according to claim 1, wherein said igniting means is a spark plug in said combustion chamber.

6. A pulse combustor according to claim 1, wherein said carburetor includes a fuel chamber having a fuel inlet, a combustion chamber inlet opening to said combustion chamber and isolated from said fuel chamber by a chamber wall, a plurality of passageways through said chamber wall for directing high velocity streams of fuel from said fuel chamber into said combustion chamber inlet and an air passageway providing fluid communication between said combustion chamber inlet and atmosphere positioned relative to said fuel streams such that atmospheric air is aspirated into said combustion chamber inlet by said fuel streams.

7. A pulse combustor according to claim 6, wherein said chamber wall is a smooth aerodynamic surface to minimize friction to air flow thereover.

8. A pulse combustor according to claim 6, wherein said inlet is positioned along an axis of said combustion chamber.

9. A pulse combustor according to claim 6, wherein said passageways are formed by a plurality of hollow needles passing through said chamber wall.

10. A pulse combustor according to claim 9, wherein said air passageway is an annulus one surface of which is formed by said chamber wall oriented so as to direct air at an acute angle to the direction of fuel flow from said needles.

11. A pulse combustor, comprising:

(a) a casing formed by a front disc and a back disc and joining means for joining said front and back disc so as to form a central combustion chamber and an exhaust region encircling said combustion chamber;

(b) igniting means for igniting a fuel mixture in said combustion chamber;

(c) a fuel inlet in fluid communication with said combustion chamber;

(d) a fuel chamber separated from said fluid inlet by a fuel chamber wall, said wall forming one surface of an air annulus communicating with a source of air;

(e) a plurality of jets passing through said fuel chamber wall for directing high velocity streams of fuel into said fuel inlet; and (f) means for cooling said front and back discs.

12. A pulse combustor according to claim 11, wherein the coolant passageways are formed in said discs and each extend in a spiral from a position proximate a center to a position proximate a periphery of an associated one of said discs.

13. A pulse combustor according to claim 11, wherein said igniting means is a spark plug located centrally of said combustion chamber opposite said inlet.

14. A pulse combustor according to claim 11, wherein the volume ratio of said exhaust region to said combustion chamber is in the range of 9 to 12.

15. A pulse combustor according to claim 14, wherein the ratio of the width of said combustion chamber to said exhaust region is in the range of 9 to 10 and the ratio of the diameter of said exhaust regions to said combustion chamber is in the range of 3.5 to 5.

16. A pulse combustor according to claim 11, wherein said jets are provided by a plurality of hollow needles passing through said chamber wall.

17. A pulse combustor according to claim 16, including a conical opening to said inlet and a mating conical nozzle surface spaced from said inlet conical opening so as to provide a conical air gap interconnecting atmosphere to the inlet.

18. A pulse combustor according to claim 16, wherein said needles are 16 gauge and are equi-spaced from each other and positioned so as to cover a notional square surface when viewed from an end thereof.

* * * * *